United States Patent [19]

Thompson, Sr.

[11] Patent Number: 4,780,964

[45] Date of Patent: Nov. 1, 1988

[54] PROCESS AND DEVICE FOR DETERMINING THE END OF A PRIMARY STAGE OF FREEZE DRYING

[75] Inventor: Taylor N. Thompson, Sr., Kingston, N.Y.

[73] Assignee: FTS Systems, Inc., Stone Ridge, N.Y.

[21] Appl. No.: 126,277

[22] Filed: Nov. 30, 1987

[51] Int. Cl.[4] ..... F26B 5/06

[52] U.S. Cl. ..... 34/5; 34/15; 34/44; 34/53; 34/92

[58] Field of Search ..... 34/5, 15, 92, 44, 53, 34/51

[56] References Cited

U.S. PATENT DOCUMENTS

| | | | |
|---|---|---|---|
| 3,178,829 | 4/1965 | Cox | 34/92 |
| 3,192,643 | 7/1965 | Rieutord | 34/92 |
| 3,233,333 | 2/1966 | Oppenheimer | 34/92 |
| 3,259,991 | 7/1966 | Illich, Jr. | 34/5 |
| 3,262,212 | 7/1966 | Buhr | 34/53 |
| 3,352,024 | 11/1967 | Mellor | 34/5 |
| 4,547,977 | 10/1985 | Tenedini et al. | 34/92 X |
| 4,597,188 | 7/1986 | Trappler | 34/5 |

*Primary Examiner*—Steven E. Warner

*Attorney, Agent, or Firm*—Robert E. Wagner; Ralph R. Rath

[57] ABSTRACT

A tray-type freeze drying device determines the end of a first stage of a freeze drying process by regularly and drastically reducing the pressure surrounding the product being freeze dried. No decrease in product temperature during the reduction in pressure indicates the completion of the sublimation of water from the product and the end of the first stage of drying. A decrease in product temperature during the drastic reduction in pressure indicates the need to continue the sublimation procedure and the first stage of drying.

10 Claims, 3 Drawing Sheets

○ $T_S$ SHELF TEMPERATURE
× $T_P$ PRODUCT TEMPERATURE
△ $V_C$ CHAMBER VACUUM
INITIALIZE
PRIMARY DRYING STAGE
SECONDARY STAGE
80
82
84
$V_C$
$T_P$
$T_S$
86
88
90
92
94
96
98
100
102
VACUUM
MILLI TORR
2000
1000
800
10-20
0
TEMPERATURE °C
+50°C
+40
+30
+20
+10
0°C
-10
-20
-30
-40
-50°
TIME (HOURS)
0
1
2
3
4
5
6
7
8
9
10
11
12
13
14
15

PROCESS AND DEVICE FOR DETERMINING THE END OF A PRIMARY STAGE OF FREEZE DRYING

DESCRIPTION

CROSS REFERENCE TO RELATED APPLICATION

This invention relates to the invention disclosed and claimed in U.S. patent application Ser. No. 07/126,752, filed Nov. 30, 1987, and titled "Freeze Dryer for Unattended Operation" in the name of Taylor N. Thompson, Sr., filed concurrently with the present application. The present application

BACKGROUND OF THE INVENTION

This invention relates generally to processes and devices for conducting lyophilization or freeze drying procedures, and particularly relates to determining the end of a primary stage in a freeze drying procedure conducted in a tray-type device.

Freeze-drying devices are known that remove water from products by lyophilization or freeze drying procedures. In particular, tray freeze drying devices present a chamber in which trays of products are placed on shelves. Product can be contained in bottles or can be in bulk and loose in the tray. The trays rest on shelves in the chamber during the freeze drying process.

These tray-type freeze drying devices usually operate in three different stages. The first or initialization stage freezes the product to a low temperature such as −40° Centigrade to insure that the product falls well below its eutectic temperature and that the entire solution becomes frozen. Next, a primary drying stage removes moisture from the frozen product by sublimation. This occurs by maintaining the temperature of the product below its eutectic temperature and encouraging the frozen water to leave the product in the form of vapor. The vapor becomes collected elsewhere on such as a condenser. This primary drying stage operates at moderate shelf temperatures and vacuums of substantially 800 milliTorr. The last or secondary drying stage removes the remaining one or two percent of water from the product by desorption; the device substantially reduces the pressure surrounding the product and increases the product temperature. This substantially removes the moisture remaining in the product.

Previously, the operator of a tray type drying device had no positive indication of the end of a primary stage and the beginning of a secondary drying stage. An inexperienced operator would conduct the primary stage for an extended period of from 12–24 hours to insure completion of the primary stage or attempt to view the product occasionally to see if the product looked dry. More experienced operators would maintain the shelf temperature constant and look for a rise in product temperature to indicate the end of the primary stage. The problem with this latter method is that a rise in product temperature could also mean that the product was melting. What is needed then is a positive indication of the end of a primary stage of freeze drying.

SUMMARY OF THE INVENTION

The invention determines the end of the primary drying stage by drastically reducing the pressure in the chamber and sensing no change in temperature of the product. This improves the efficiency of the freeze drying device by positively determining the end of the primary drying stage.

In particular, a tray-type drying device operates in accordance with the invention by periodically and substantially reducing the pressure in the freeze drying chamber while sensing the temperature of the product being freeze dried. If the temperature of the product decreases with the decrease in chamber pressure, the product still contains substantial moisture, and the device returns the freeze drying process to the primary drying stage. The temperature of the product remaining constant, however, indicates substantial completion of the sublimation of water from the product and the end of the primary drying stage. The process of the invention then proceeds to the second stage drying of desorption.

In the preferred embodiment, the substantial decrease in pressure occurs hourly and a decrease in product temperature of a few degrees indicates that the primary drying stage should continue. The pressure decrease can be several hundred milliTorr and need last only a moment to ascertain if there is any corresponding drop in product temperature.

DESCRIPTION OF THE PREFERRED EMBODIMENT

Figure 1:
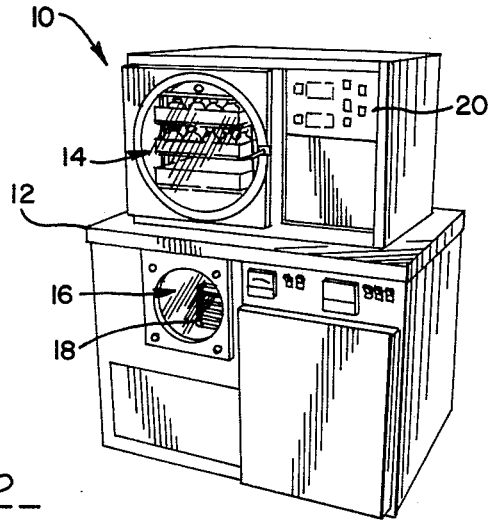
FIG. 1 is a perspective view of a tray-type freeze drying device that operates according to the invention.
Figure 2:
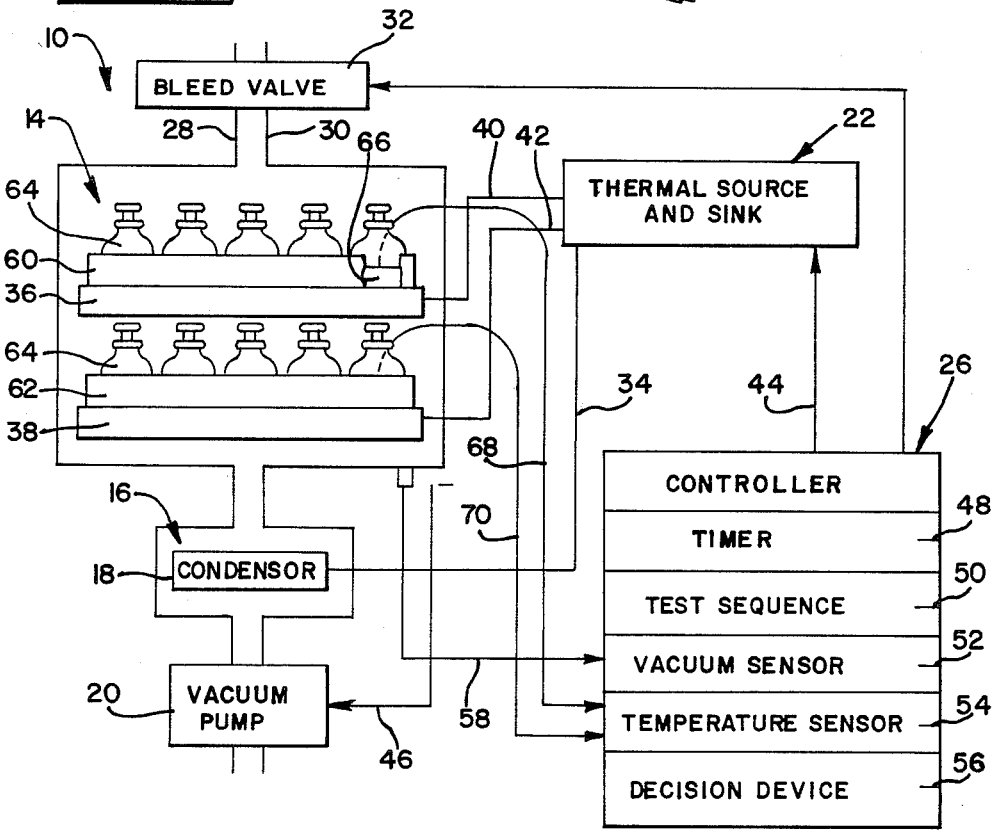
FIG. 2 is a schematic block diagram of a device incorporating the invention.

Referring to FIGS. 1 and 2, a freeze drying device 10 of the invention comprises a cabinet 12 enclosing a freeze drying chamber 14, a condenser chamber 16, and a condenser coil 18 located within condenser chamber 16. Cabinet 12 also presents a control panel 20. In FIG. 2, device 10 also includes a thermal source and sink 22 that comprises desired heating elements and mechanical refrigeration systems, a vacuum pump 24 and a controller 26. Device 10 also presents interior walls 28 and 30 schematically drawn to extend from a bleed valve 32, enclosing freeze drying chamber 14, enclosing condenser chamber 16 and extending to vacuum pump 24.

Thermal source and sink 22 connects to the condenser coils 18 through pipes 34 and to shelves 36 and 38, which are mounted in the freeze drying chamber 14, by pipes 40 and 42 respectively. In this manner the thermal source and sink 22 supplies or removes heat to and from the shelves 36 and 38 and removes heat from the condenser coils 18 to control the freeze drying processing. Thermal source and sink 22 in turn becomes controlled by controller 26 over leads 44. Controller 26 also controls the operation of vacuum pump 24 over leads 46.

Controller 26 includes a timer 48, a test sequencer 50, a vacuum sensor 52, a temperature sensor 54 and a decision device 56. Vacuum sensor 52 senses the vacuum in the freeze drying chamber 14 over leads 58. In practice, these devices comprise any desired analog and digital components or software program steps operating such as a micro computer to obtain or effect the described functions.

In operation, the freeze drying chamber 14 contains trays of sample bottles containing product to be freeze dried such as trays 60 and 62 containing bottles 64 of product 66. This arrangement of trays, bottles and product can be effected as desired. Temperature sensor 54 reads the temperature of the product 66 by way of thermocouple leads 68 and 70.

Figure 3:
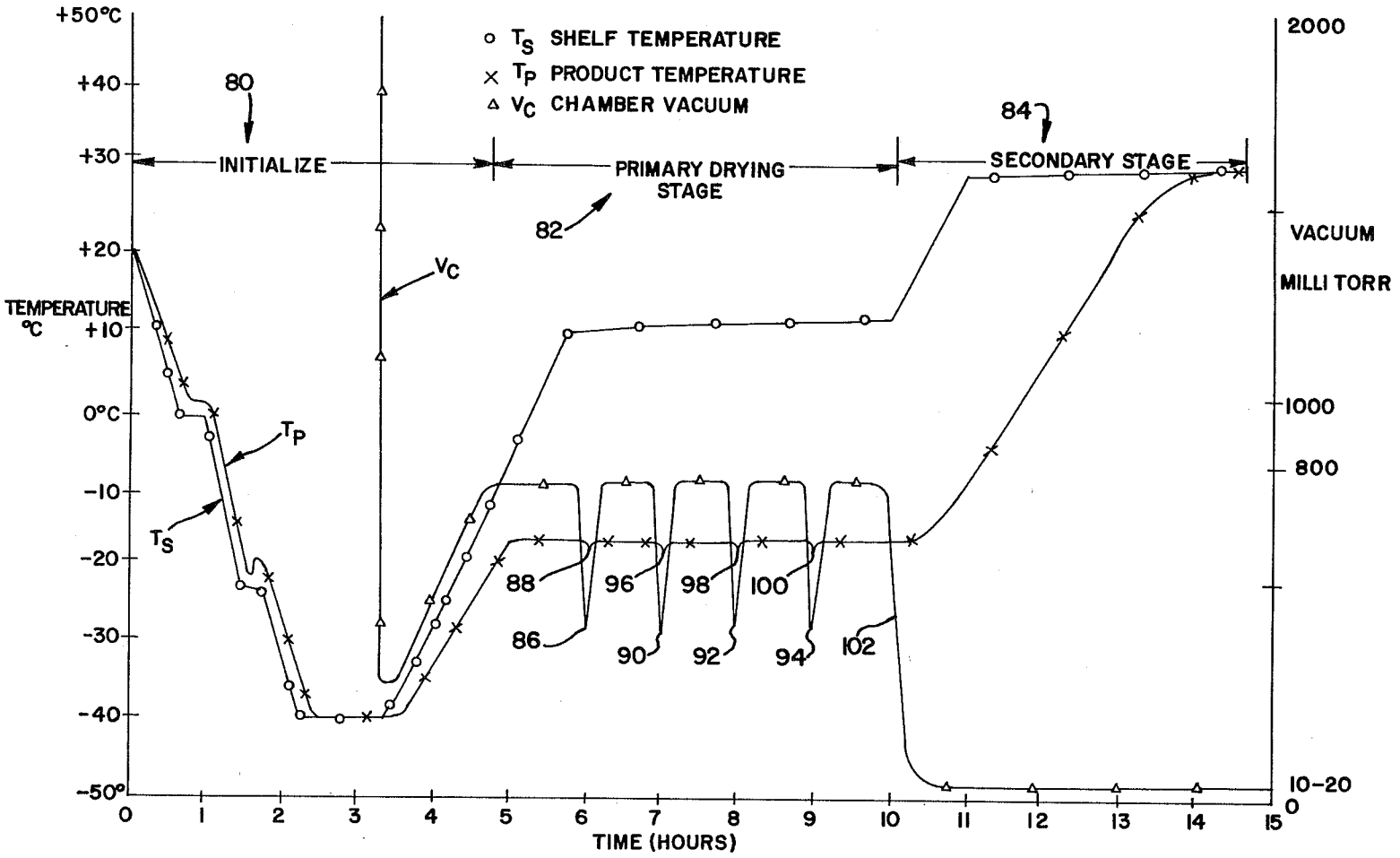
FIG. 3 is a graph of temperatures and pressures versus time depicting procedures of the invention.

Referring to FIG. 3, device 10 operates over time to effect a freeze drying procedure comprising an initialization stage 80, a primary drying stage 82 and a secondary drying stage 84. During the initialization stage, the product 66 becomes loaded in the freeze drying device 10 and the thermal source and sink 22 begins operating. From approximately room ambient temperature of +20° Centigrade the thermal source and sink 22 lowers the temperature of the shelf $T_S$ and of the product $T_P$ to approximately −40° Centigrade. This insures freezing of the product well below its eutectic temperature. After attaining the −40° Centigrade temperature, the device operates the vacuum pump to reduce the chamber vacuum. Device 10 then adjusts the vacuum $V_C$ and shelf temperature $T_S$ to end the initialization stage 80 and to begin the primary drying stage 82.

In this stage the vacuum becomes raised to approximately 800 milliTorr while the shelf temperature $T_S$ attains approximately +10° Centigrade. With these parameters, the product remains at approximately −20° Centigrade, below its eutectic temperature. In this stage, the frozen water sublimates from the frozen product and becomes condensed on condenser coils 18 in the form of ice in a known and previously used manner.

After a desired period, such as may be set in timer 48, controller 26 operates the vacuum pump 24 and the bleed valve 32 to effect a fast and great reduction in the chamber vacuum $C_V$. This can occur by maintaining operation of pump 24 and closing valve 32 to reduce the pressure in chamber 14. In FIG. 3, this reduction in vacuum is indicated to be several hundred milliTorr to about 500 milliTorr, but can be well below 500 milliTorr as may be desired. Vacuum sensor 52 monitors this vacuum value.

Temperature sensor 54, by way of leads 68 and 70, monitors the temperature of the product 66, and when the temperature drops, such as at spike 88, from its steady state temperature in the primary drying stage, decision device 56 determines that a substantial quantity of water remains in the product and that the primary drying stage must continue. Controller 26 then returns the vacuum to its steady state value of approximately 800 milliTorr. This restarts timer 48. When timer 48 again completes its timing function, test sequencer 50 proceeds to effect another temperature spike and the reading of the product temperature. In the example of FIG. 3, the vacuum spikes 90, 92 and 94 occur respectively at 7, 8 and 9 hours of operation. Each vacuum spike produces respective temperature drop 96, 98 and 100. Experimentally it has been determined that a product temperature drop of 1° Centigrade with a 200 milliTorr drop in pressure positively indicates the continuance of the sublimation procedure or the primary drying stage.

In practice, the reduction in pressure is unregulated and occurs substantially too fast to b well regulated. At higher product temperatures, the temperature drop occurs faster than at lower product temperatures.

At approximately 10 hours of operation, the timer 48, test sequencer 50, vacuum sensor 52, temperature sensor 54 and decision device 56 again act to reduce the chamber vacuum $V_C$, indicated as curve 102. At this time, however, there is substantially no drop in product temperature; decision device 56 accordingly positively determines the end of the primary drying stage.

The controller then lowers the chamber vacuum $V_C$ to about 10–20 milliTorr while the shelf temperature $T_S$ rises to substantially 28° Centigrade. This begins the desorption of water from product 66 in secondary drying stage 84.

Figure 4:
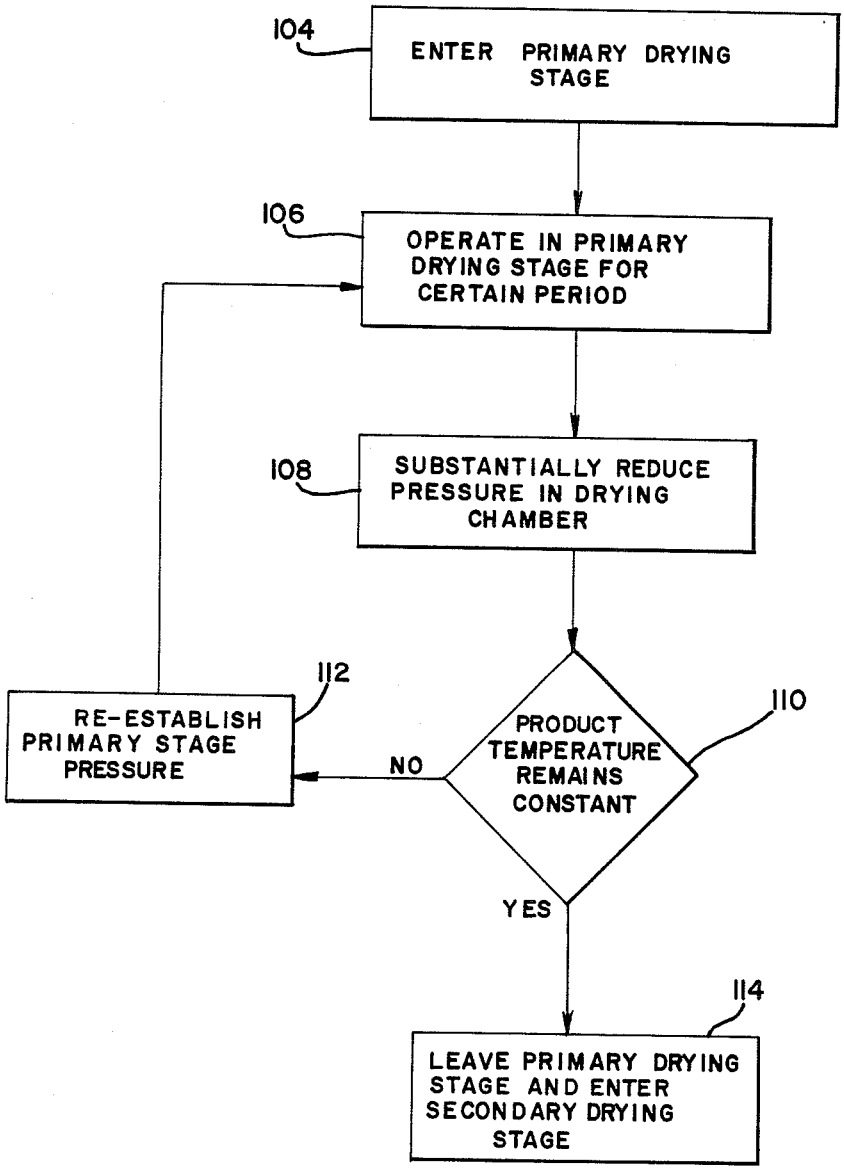
FIG. 4 is a flow chart of the process of the invention.

In FIG. 4, the process of the invention starts in block 104, with the controller 26 acting to cause device 10 to enter the primary drying stage 82. In block 106, device 10 operates in the primary drying stage for a certain period. This certain period is effected with timer 48 in hardware or software. Thereafter, test sequencer 50 causes the controller 26 to act at program block 108 substantially to reduce pressure in the drying chamber 14. This occurs at each of pressure spikes 86, 90, 92, 94 and 102. In decision block 110, decision device 56 determines whether the product temperature remains constant. If not, controller 26 acts at program block 112 to re-establish the primary stage pressure and to return operation to block 106. This effectively resets the timer 48.

If the product temperature does remain constant, controller 26 acts to leave the primary drying stage 82 and enter the secondary drying stage 84 with the necessary changes in temperatures and pressures. This occurs at process block 114. In this manner, device 10 acts to determine the end of the primary drying stage 82 by significantly reducing the chamber vacuum $V_C$ and sensing any change in product temperature $T_P$.

In the preferred embodiment, controller 26 is a microprocessor containing software programming to effect the operation of the freeze drying procedure in device 10. Particularly, the software effects the program steps represented in FIG. 4. The time between vacuum spikes can be modified as desired from the one-hour intervals illustrated in FIG. 3. The preferred embodiment and the specifics of the process can be modified as desired while staying within the appended claims.

I claim:

1. A method for determining the end of a primary stage of a freeze drying process that dries a product in a tray drying device, said freeze-drying process effecting said primary stage of drying by sublimation and effecting said secondary stage of drying by desorption, said method comprising:

A. effecting said primary stage by subjecting said product to a desired heat of sublimation and a pressure at a substantially constant first value so that said product remains at a substantially constant first temperature to effect said sublimation;

B. substantially reducing said pressure from said first value while maintaining constant the rate of application of said heat of sublimation;

C. measuring the temperature of said product during said reduction in said pressure from said first value:

D. increasing said pressure to said first value and repeating steps A through C upon the temperature of said product falling below said first temperature during said reduction in said pressure; and E. ending said primary stage and entering said secondary stage upon the temperature of said product remaining constant during said reduction in said pressure.

2. The process of claim 1 in which substantially reducing said pressure includes reducing said pressure at least several hundred milliTorr.

3. The process of claim 1 in which substantially reducing said pressure includes maintaining the operation of a vacuum pump that reduces the pressure surrounding said product and closing a bleed valve that normally admits limited amounts of gas to surround said product.

4. The process of claim 1 including substantially reducing said pressure at regular intervals during said primary stage.

5. The process of claim 4 in which said intervals occur hourly.

6. A tray drying device that determines the end of a primary stage of a freeze drying process which dries a product, in which said freeze-drying process effects said primary stage of drying by sublimation and effects said secondary stage of drying by desorption, said device comprising:

A. a freeze-drying chamber adapted to contain said product;

B. pump means for controlling the pressure surrounding said product in said chamber at desired values in response to an electrical pressure signal;

C. thermal means for controlling the heat applied to said product in said chamber in response to an electrical thermal signal; and D. control means for effecting said primary stage by producing said electrical pressure and thermal signals to subject said product to a desired heat of sublimation and a pressure at a substantially constant first value so that said product remains at a substantially constant first temperature to effect said sublimation, said control means including:

E. timer means for initiating a test sequence at a desired interval;

F. test sequence means for substantially reducing said pressure from said first value while maintaining constant the rate of application of said heat of sublimation at the time of said test sequence interval;

G. measuring means for measuring the temperature of said product during said reduction in said pressure from said first value; and H. decision means for increasing said pressure to said first value and restarting said timer means upon the temperature of said product falling below said first temperature during said reduction in said pressure, and ending said primary stage and entering said secondary stage upon the temperature of said product remaining constant during said reduction in said pressure.

7. The device of claim 6 in which said timer means effects intervals occurring hourly.

8. The device of claim 6 in which said timer means effects intervals occurring regularly.

9. The device of claim 6 including bleed valve means normally for controlling the entrance of gases into said chamber means, and said sequence means effecting said reduction in pressure by closing said bleed valve means and maintaining operation of said pump means.

10. The device of claim 6 in which said first pressure value is approximately 800 milliTorr and said sequence means reduce said pressure in said chamber means by several hundred milliTorr.

* * * * *